US005121718A

United States Patent [19]

Saito

[11] Patent Number: 5,121,718

[45] Date of Patent: Jun. 16, 1992

[54] VALVE AND SPRING ARRANGEMENT FOR ENGINE

[76] Inventor: Tetsushi Saito, c/o 2500 Shingai, Iwata-shi Shizuoka-Ken, Japan

[21] Appl. No.: 553,532

[22] Filed: Jul. 13, 1990

[30] Foreign Application Priority Data

Jul. 13, 1989 [JP] Japan ..... 1-178959
Jul. 14, 1989 [JP] Japan ..... 1-181892

[51] Int. Cl.[5] ..... F01L 1/04; F01L 3/10

[52] U.S. Cl. ..... 123/90.27; 123/90.67; 123/90.6; 123/193.5

[58] Field of Search ..... 123/432, 315, 90.22, 123/90.27, 90.6, 90.28, 193 H, 193 CH, 308, 90.23, 188.5 B, 90.65, 90.66, 90.67

[56] References Cited

U.S. PATENT DOCUMENTS 2,689,557 9/1954 Taylor ..... 123/90.65
2,862,485 12/1958 Skinner ..... 123/90.6
4,409,935 10/1983 Henn et al. ..... 123/90.6
4,538,563 11/1985 Mayers ..... 123/90.65
4,612,885 9/1986 Yoshikawa ..... 123/193 CH
4,617,881 10/1986 Aoi et al. ..... 123/90.22
4,951,622 8/1990 Takahashi et al. ..... 123/193 H
4,972,813 11/1990 Sugiura ..... 123/193 H
4,977,863 12/1990 Kronich ..... 123/90.23

FOREIGN PATENT DOCUMENTS 3402605 8/1985 Fed. Rep. of Germany ..... 123/90.6
882050 11/1961 United Kingdom ..... 123/188.5 B

*Primary Examiner*—E. Rollins Cross
*Assistant Examiner*—Thomas N. Moulis

[57] ABSTRACT

A cylinder head construction for an internal combustion engine that permits a large number of valves to be employed and good bearing surface without interfering with the insertion or removal of the multiple valve springs. This is accomplished by providing a relief in one of the camshaft journals that is juxtaposed to one of the valves so that the valve spring can be easily inserted and removed. In addition, the seating area for the valve springs in the cylinder head is machined to a diameter smaller than the diameter of the valve springs and a spring seating member is interposed between this cylinder head surface and the adjacent end of the valve spring and has a diameter at least equal to that of the valve spring.

27 Claims, 6 Drawing Sheets

VALVE AND SPRING ARRANGEMENT FOR ENGINE

BACKGROUND OF THE INVENTION

This invention relates to a valve and spring arrangement for an engine and more particularly to an improved compact engine construction that permits the use of multiple valves.

It is well known that the performance of an internal combustion engine can be increased by employing a greater number of valves for each cylinder. The use of additional valves increases the volumetric efficiency of the engine. For that reason it has been the normal practice to employ four valves per cylinder in high performance engines. Recently, however, certain problems associated with the use of more than four valves per cylinder have been overcome through the valve placement that permits a compact combustion chamber and high compression ratios while still permitting the use of five valves per cylinder. However, as the number of valves per cylinder increases, there are additional problems in connection with the engine layout and particularly with the components associated with the valve train.

Specifically, if multiple valves are employed and they are all operated by a single camshaft, then the placement of the valve springs and their association with the bearings for the associated camshaft can present some problems. That is, it is important to provide a good bearing support for the camshaft so that it will not distort. However,,-the normal practice is to form the bearing journals in the cylinder head and bearing caps associated with it. Wherein the valves are closely placed to each other and wherein multiple bearings are employed for the camshaft, the camshaft bearings can interfere with the placement of the valve springs. Although relocation of the valves could solve this problem, it is necessary to correctly position the valves so as to achieve the desired combustion chamber configuration.

It is, therefore, a principal object of this invention to provide an improved valve and spring arrangement for a multiple valve engine.

It is a further object of this invention to provide a multiple valve spring arrangement for an engine wherein the valve springs can be installed and removed without interference from other components of the engine.

As has been noted, the use of five valves per cylinder which incorporates three intake valves has been found to provide extremely good performance for an engine. However, if the three intake valves are all operated by independent cam lobes, it is desirable to provide bearings between the cam lobes and on opposite sides of the center cam lobe. However, this is very close to the positioning of the center intake valve. Prior art constructions have made it difficult to locate and install the valve spring for the center intake valve where such a bearing arrangement is employed.

It is, therefore, a further object of this invention to provide an improved bearing and spring arrangement for a multiple valve engine wherein the camshaft can be adequately supported and the associated valve springs still easily installed and replaced.

With regard to the aforenoted problems, it is also desirable to be able to provide a relatively large diameter spring for operating on the valves. Normally the spring bears directly against the cylinder head and this involves machining the cylinder head surface to a diameter equal to the maximum diameter of the spring to achieve the desired bearing surface. With the aforenoted space problems, this machining can give rise to additional problems.

It is, therefore, a further object of this invention to provide a improved cylinder head and valve spring construction wherein the valve spring can have a large bearing area but wherein the machining of the cylinder head is facilitated.

SUMMARY OF THE INVENTION

A first feature of this invention is adapted to be embodied in a cylinder head for an internal combustion engine and in which a valve guide is positioned in the cylinder head for supporting a poppet valve for reciprocation along an axis. A camshaft journal is formed integrally by the cylinder head and is juxtaposed to the valve guide. A relief is formed in the camshaft journal for passage of a coil spring to be positioned and removed from a valve slidably supported by the valve guide.

Another feature of the invention is also adapted to be embodied in a cylinder head ,construction for an internal combustion engine that includes a valve guide in the cylinder head for supporting a poppet valve for reciprocation along an axis. The cylinder head has a cylindrical bearing surface that is smaller in diameter than the coil spring associated with the valve and which surrounds the valve guide. A bearing member is interposed between this cylinder head surface and one end of the valve spring and has a diameter larger than the cylinder head surface and at least approximately equal to or greater than the diameter of the valve spring.

DETAILED DESCRIPTION OF THE PREFERRED EMBODIMENT OF THE INVENTION

Figure 1:
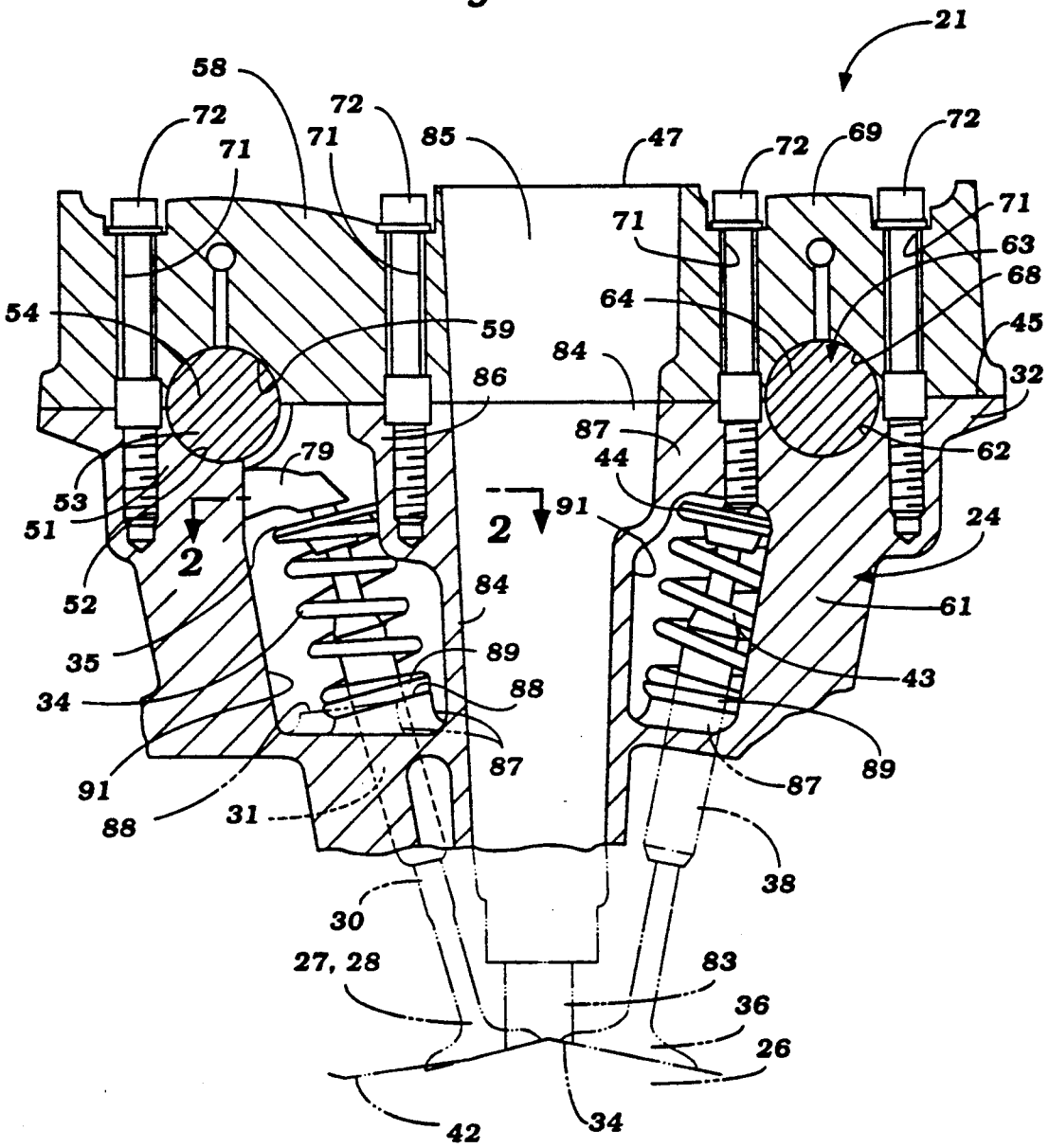
FIG. 1 is a cross sectional view taken generally along the line 1—1 of FIG. 5 and shows a portion of a cylinder head assembly constructed in accordance with an embodiment of the invention.

Referring now in detail to the drawings, a multiple cylinder internal combustion engine, constructed in accordance with an embodiment of the invention is identified generally by the reference numeral 21. The engine 21 includes a cylinder block 22 which may be conventional and hence is only shown in phantom in FIG. 4 in which a plurality of aligned bores 23 are formed. In the illustrated embodiment, the engine 21 is of the four cylinder in line type. It should be readily apparent, however, to those skilled in the art how the invention can be practiced in conjunction with engines having other numbers of cylinders and other cylinder configurations.

Since the invention deals primarily with the cylinder head assembly and more particularly to the valve actuating mechanism therefor, the details of the cylinder block, pistons and running component of the engine which may be considered to be conventional are not believed to be necessary to enable those skilled in art to practice the invention. Therefore, the cylinder head and valve train assembly therefor will now be described.

A cylinder head assembly, indicated generally by the reference numeral 24 is affixed to the cylinder block 22 by mean of a plurality of fasteners 25 that pass through appropriate openings in the cylinder head 24 and which are threaded into threaded openings in the cylinder block. It should be noted that the fasteners 25 are disposed so that they will be located at the four corners of the cylinder bores 23, as indicated by the broken circles in FIG. 5, to show the relationship of these fasteners 25 to the cylinder bores 23.

The lower face of the cylinder head 24 is provided with a plurality of recesses 26 which have a generally pent roof configuration, as will be described. Three intake valves comprised of a pair of center intake valves 27 and 28 and a side intake valve 2 each have valve stems 30 supported for reciprocation within the cylinder head 24 by respective valve guides 31. It will be noted that the intake valves 27, 28 and 29 are oriented so that the center intake valves 27 and 28 reciprocate along axes $Y_1$ (FIG. 4) that are disposed at a relatively large acute angle $\alpha_2$ to a plane $A_1$ containing the cylinder bore axis $X_2$ and extending parallel to the axis of rotation of the associated crankshaft.

Figure 4:
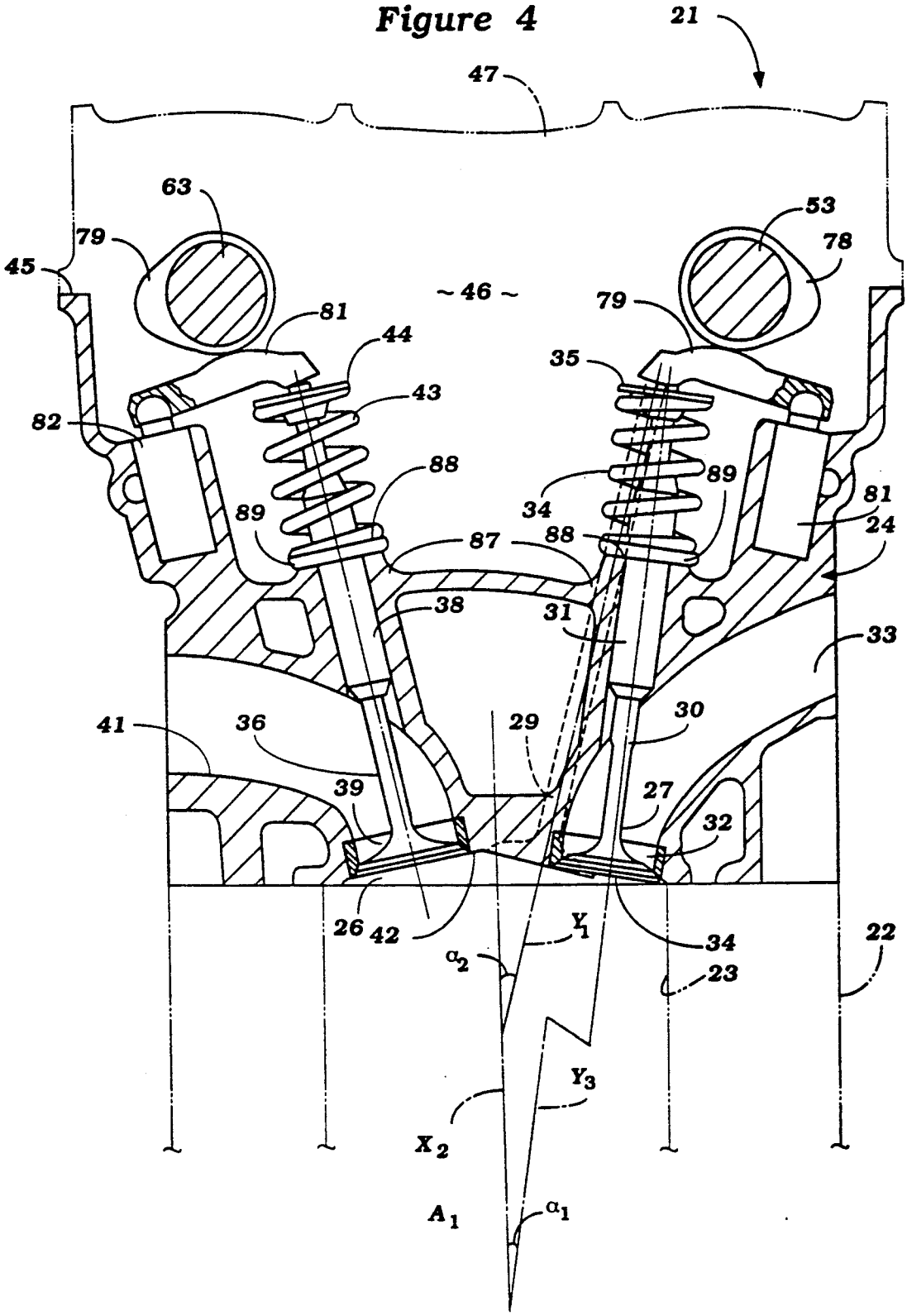
FIG. 4 is a cross sectional view taken along the line 4—4 of FIG. 5 and shows certain components of the cylinder head assembly and the associated cylinder block in phantom.

The side intake valve 29 reciprocates about an axis $Y_3$ which is disposed at a lesser acute angle to this plane, this angle being indicated at $\alpha_1$ in FIG. 4. This angular relationship and the reason for it is more fully described in my copending application entitled "Valve Actuating Arrangement For Engine", Ser. No. 07/550,383, filed Jul. 10, 1990 and assigned to the Assignee of this application. That disclosure is incorporated herein by reference. For that reason, it will not be described in more detail.

Figure 6:
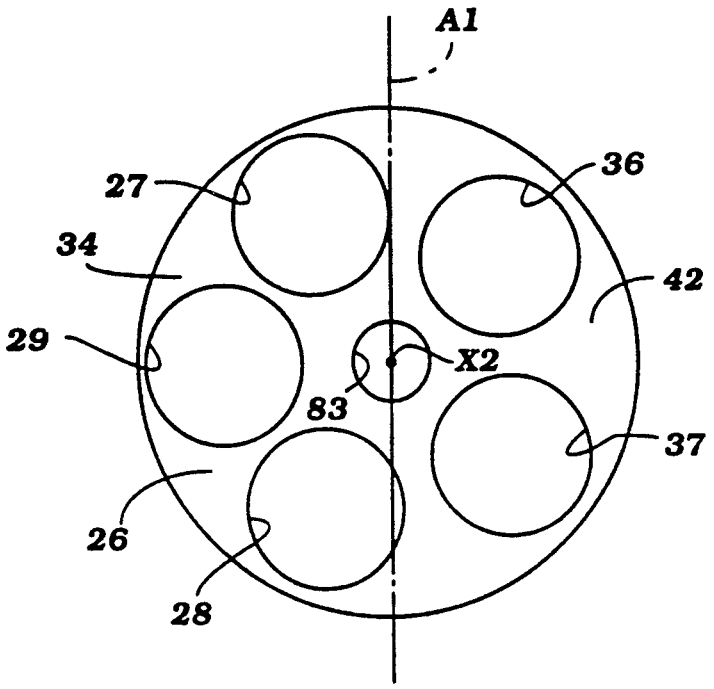
FIG. 6 is a bottom plan view of the combustion chamber configuration.

Each of the intake valves 27, 28 and 29 cooperates with a respective valve seat 32 pressed, into the cylinder head 24 and defining an intake port at the termination of an intake passage 33 which extends through one side of the cylinder head. The intake passages 33 may be siamese so that one intake opening in the side of the cylinder head cooperates with each of the valve seats 32 or, alternatively, separate passages may be formed for each valve seat. The orientation of the heads of the valves 27, 28 and 29 gives the lower surface of the cylinder head cavity 26 a generally inclined portion 34 which extends across the plane $A_1$ so that a portion of the heads of the valves 27 and 28 lies on the opposite side of this plane when the valves are closed, as clearly shown in FIG. 6.

Coil compression springs 34 encircle the stems of the valves 27, 28 and 29 and act against keeper retainer assemblies 35 for urging the valves 27, 28 and 29 to their closed positions. The mechanism for opening the intake valves 27, 28 and 29 will be described later.

A pair of exhaust valves 36 and 37 are supported for reciprocation on the other side of the plane A by valve guides 38 which are pressed into the cylinder head assembly 24. The exhaust valves 36 and 37 reciprocate about respective axes which are disposed at an acute angle $\alpha$ to the plane A which angle $\alpha$ is less than the angle $\alpha_2$ and greater than the angle $\alpha_1$ as noted in my copending application Ser. No. 07/550,383. The exhaust valves 3 and 37 cooperate with respective valve seats 39 that are pressed into the cylinder head 24 and which form the exhaust ports of exhaust passages 41 that extend through the side of the cylinder head 24 opposite to the intake side. As with the intake passages 33, the exhaust passages 41 may be separate or siamese. It should be noted that the disposition of the heads of the exhaust valves 36 and 37 gives rise to the combustion chamber cavity having a generally inclined surface 42 that intersects the surface 34 on the exhaust side of the plane $A_1$ so that this intersection is slightly offset to the side of the combustion chamber.

Coil compression springs 43 cooperate with keeper retainer assemblies 44 on the stems of the exhaust valves 36 and 37 for urging the exhaust valves 36 and 37 to their closed positions.

The relationship of the axes $Y_2$ of the exhaust valves 36 and 37 is as described in more detailed in my aforenoted copending application Ser. No. 07/550,383. For that reason, further description is believed to be unnecessary, since this particular orientation is not the subject matter of this application.

The mechanism for opening the intake valves 27, 28 and 29 and exhaust valves 36 and 37 against the operation of the respective springs 34 and 43 will no be described. The cylinder head 24 has an upstanding peripheral wall that defines an upwardly facing sealing surface 45 that defines in part a cavity 46 in which the valve actuating mechanism is contained. The cavity 46 is enclosed by means of a cam cover 47 that is affixed to the cylinder head 24 in a manner as will be described. On the intake side of the cylinder head 24 there is provided a plurality of bosses 48 which define generally semi cylindrical shaped bearing surfaces 49. Adjacent the bosses 48, there are provided further bosses 51 that define quarter cylindrical bearing surfaces 52. An intake camshaft, indicated generally by the reference numeral 53 has spaced bearing surfaces 54 that are received within and journaled on the cylinder head bearing surfaces 49 and 52. The cylinder head 24 further has end bosses 55 that define further semi cylindrical bearing surfaces with which bearing portions 56 of the camshaft 53 cooperate so as to rotatably journal it. Unlike conventional arrangements wherein separate bearing caps are provided, in accordance with a feature of the invention, the cam cover 47 has a plurality of inwardly extending portions 58 that define semi cylindrical bearing surfaces 59 which cooperate with the camshaft bearing surface 54 and 56, respectively, so as to complete the journaling of the intake camshaft 53 in the cylinder head assembly.

The exhaust side of the cylinder head assembly 47 also has a plurality of inwardly extending bosses 61 which have respective bearing surfaces 62 which are of a semi cylindrical configuration. An exhaust camshaft 63 is rotatably journaled on these bearing surfaces by means of bearing portions 64 formed integrally thereon. In addition, end walls 65 of the cylinder head 24 are provided with bearing surfaces 66 which cooperate with end bearing surfaces 67 on the exhaust camshaft 63 for its rotational support. It should be noted that the intake camshaft 53 and exhaust camshaft 63 rotate about parallel axes which are parallel to the axis of rotation of the associated crankshaft.

Cooperating with the cylinder head bearing surfaces 62 and 66 are bearing surfaces 68 formed, in inwardly extending portions 69 of the cam cover 47.

Figure 7:
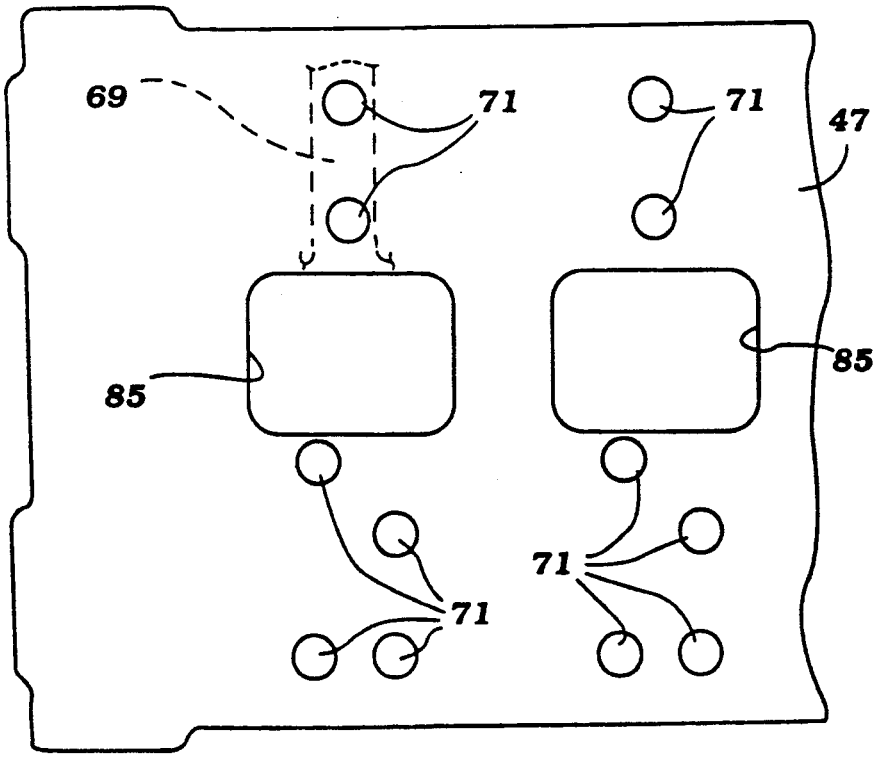
FIG. 7 is a top plan view of the cam cover of the engine.

The cam cover 47 is provided with a plurality of appropriately spaced bolt clearance holes 71 that are positioned in a pattern as best shown in FIG. 7, and which receive bolts 72 that are threaded into tapped openings formed in the cylinder head 24 so as to secure the bearing caps formed by the cam cover 47 and the cam cover in place. Because of this construction, the head assembly may be made more compact than prior art arrangements and also the use of separate bearing caps for the camshaft may be avoided.

A toothed sprocket 73 (FIG. 5) is affixed to one exposed end of the exhaust camshaft 63 and is driven by a toothed belt 74 in timed relationship with the engine crankshaft (not shown). At the opposite end of the exhaust camshaft 63, and within the cylinder head assembly 24, there is affixed a sprocket 75. A chain 76 encircles the sprocket 75 and drives a sprocket 77 that is affixed to the intake camshaft 53 at this end. In this way, the intake and exhaust camshafts will be driven in timed relationship from the engine output shaft.

Figure 2:
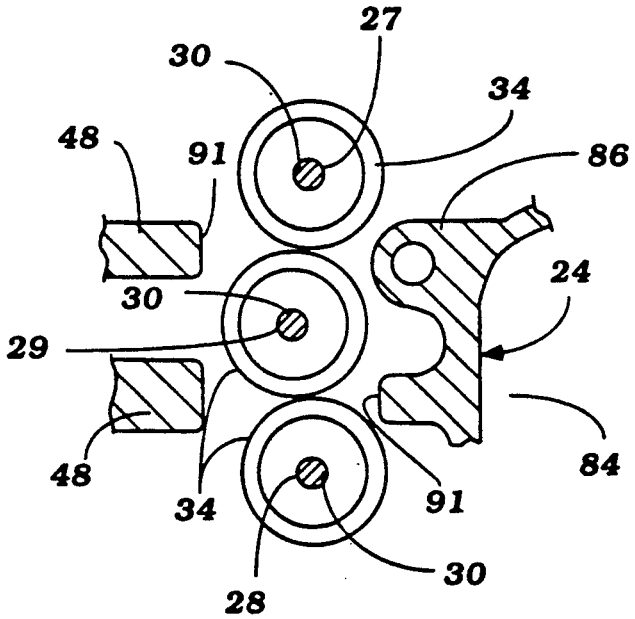
FIG. 2 is a cross sectional view taken along the line 2—2 of FIG. 1.

In order to operate the intake valves 27, 29 and 28, there are provided three cam lobes 78 on the intake camshaft 53 for each cylinder. One of the cam lobes 78 is disposed between the bearing surfaces 49 and 52 and the camshaft bearing surfaces 54. The other of the cam lobes 78 are positioned outwardly of these bearing surfaces. Individual rocker arm assemblies 79 (FIGS. 2 and 3) have an intermediate portion that is engaged by the cam lobe 78 and an end portion that is engaged with the stem of the respective intake valve 27, 28 and 29. The rocker arms 79 are pivotally supported by means of a hydraulically operated lash adjuster, indicated generally by the reference numeral 81 and having a construction as described in my copending application entitled "Valve Actuating Arrangement For Engine", Ser. No. 07/550,383, filed Jul. 10, 1990 and assigned to the Assignee hereof. The hydraulically operated lash adjusters 81 are configured and operated as described in that application, the disclosure of which is incorporated herein.

In a similar manner, the exhaust camshaft 63 is provided with a pair of lobes 79 for each cylinder which cooperates with pivotally supported rocker arms 81 that are also associated with hydraulically lash adjusters 82 having the same construction.

The cylinder head 24 is provided with a tapped hole 83 (FIGS. 1 and 3) in which a spark plug (not shown) is received. The spark plug is disposed so that its gap extends into the combustion chamber 26 and lies substantially on the axis $X_2$ of the cylinder bore 23. However, the tapped hole 83 is disposed along a line $X_3$ that is at an acute angle to the bore axis 82 and which is inclined toward the exhaust valves 36 and 37 from this plane. This is to facilitate placement of the spark plug and its removal. Since there are only two exhaust valves, there is a greater space available if it is inclined in this direction.

The cylinder head 24 is provided with an enlarged tapering opening 84 that extends upwardly from the tapped opening 83 and which mates with a generally rectangular opening 85 formed in the cam cover 47 so as to facilitate insertion and removal of the spark plugs.

Figure 5:
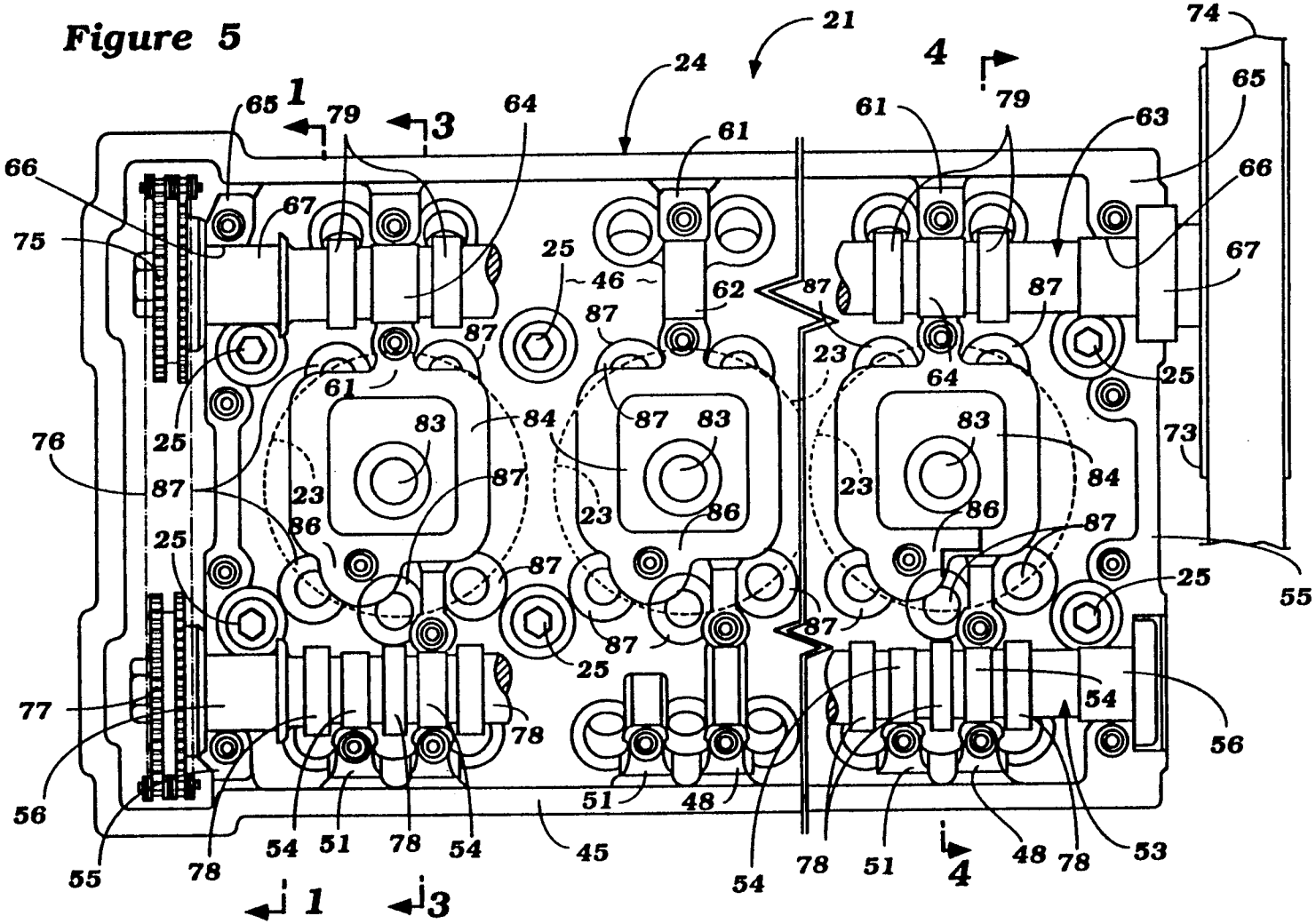
FIG. 5 is a top plan view of the cylinder head assembly with the cam cover removed and portions of the camshafts broken away to more clearly show the construction.

As may be seen in FIG. 5, the area of the cylinder head 24 that encircles the spark plug opening 84 is defined by an upstanding wall that has bosses 86 that extend toward the intake side of the cylinder head and specifically toward the intake camshaft 53. These bosses 84 receive certain of the fasteners 72 that secure the cam cover 47 to the cylinder head 24. These bosses 86 tend to overlie the are where the valve guides are positioned, particularly on the intake side. In addition, the upstanding walls that define the spark plug recesses 84 also overlie the exhaust valve seats. A similar problem occurs in connection with the placement of the bosses 48 that form the camshaft bearing journals 49 inasmuch as these bosses have portions 8 that extend inwardly and overlie the area where the intake valves are positioned. It is the normal practice to machine the area of the cylinder head where the valve springs 34 and 43 bear so as to provide a good surface against which the springs 35 and 43 act and to prevent cocking of the valve springs. However, the construction as thus far described clearly provides restriction t the portion of the cylinder head where these valves springs will seat. The seating area for the valve springs is defined by raised cylindrical areas, indicated generally by the reference numeral 87 with the same reference numeral being applied to each valve spring seating area.

In accordance with a feature of the invention, the valve spring seating areas 87 are formed at a smaller diameter than the actual diameter of the valve springs. This facilitates machining of these areas since a smaller tool is easier to utilize. This tool is employed for machining a surface 88 that surrounds the respective valve guides 31 and 38 and which is slightly smaller in diameter than the diameter of the valve springs 34 and 43. A hardened valve spring bearing member 89, which has a diameter at least equal to the diameter of the valve spring, is supported on the surfaces 88 and provides the actual bearing area for the valve springs 34 and 43. In this way it is possible to have a small machined area of the cylinder head around the respective valve guides 31 and 38 and still have a full bearing area for the coil springs 34 and 43.

Figure 3:
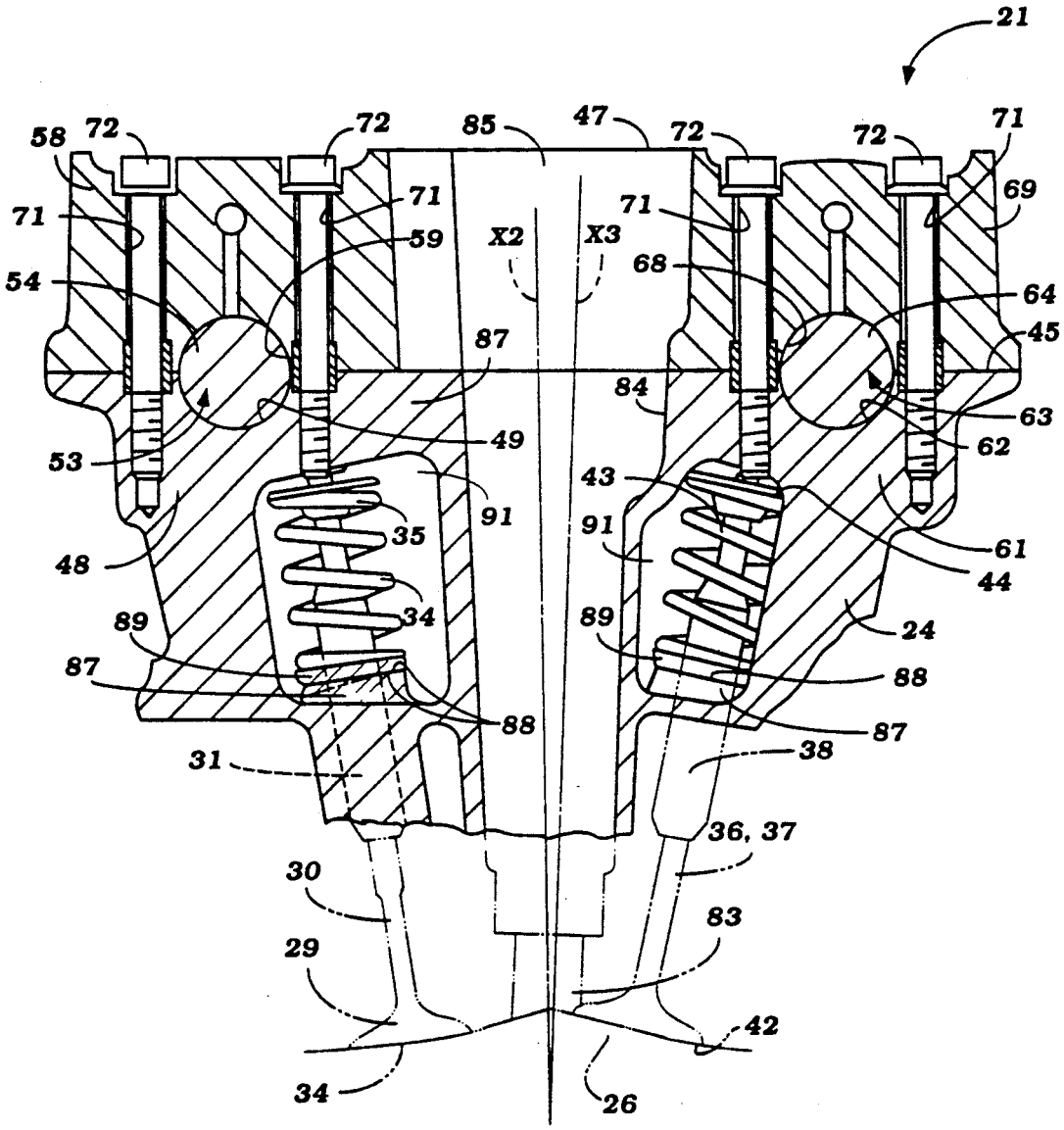
FIG. 3 is a partial cross sectional view taken along the line 3—3 of FIG. 5.

As may also be seen in the figures and particularly in FIGS. 1 and 3, the placement of the journal areas for the camshafts also gives rise to valve spring placement. However, in order to facilitate insertion and removal of the valve springs, the cylinder head is provided with a relief such as a plurality of pockets, recesses, or holes 91 in the areas where the valve springs lie so as to facilitate insertion and removal of the valve springs without interference from the bearing areas. Thus, the described arrangement easily facilitates the insertion and removal of the valve springs from around the stems of the intake and exhaust valves 27, 28, 29, 36 and 37 without weakening the cylinder head and while, at the same time, permitting the desired valve placement.

It should be readily apparent from the foregoing description that the described cylinder head construction permits the use of multiple valves per cylinder of the engine while still affording ease of access for insertion and removal of the valve springs, good camshaft bearing area and also ease of machining of the valve spring seating area in the cylinder head. It is to be understood, however, that the foregoing description is that of a preferred embodiment of the invention. Various changes and modifications may be made without departing from the spirit and scope of the invention, as defined by the appended claims.

I claim:

1. A cylinder head for an internal combustion engine, a valve guide in said cylinder head for supporting a poppet valve for reciprocation about an axis, a camshaft journal formed integrally by said cylinder head and juxtaposed to said valve guide and a relief formed in said camshaft journal for passage of a coil spring to be positioned on and removed from a valve slidably supported by said valve guide, at least a portion of said cylinder head camshaft journal lying above the level of the coil spring when positioned upon the valve.

2. A cylinder head as set forth in claim 1 wherein there are a plurality of valves and valve guides for each cylinder of the engine and the relief accommodates the insertion of the coil spring for at least one of the valves.

3. A cylinder head as set forth in claim 2 wherein the camshaft has a number of lobes equal to the valves so that each valve is operated by a respective cam lobe.

4. A cylinder head as set forth in claim 3 wherein the camshaft journal is formed between a pair of the cam lobes.

5. A cylinder head as set forth in claim 4 wherein at least two of the poppet valves reciprocate about axes that are not parallel to each other and which are disposed at different acute angles to a plane containing the axis of the associated cylinder bore.

6. A cylinder head as set forth in claim 5 wherein the cylinder head is provided with a machined surface surrounding the valve guide and adapted to form a reaction surface for the associated coil spring, said surface having a smaller diameter than the diameter of the coil spring and further including a spring bearing member having a diameter at least equal to the diameter of the coil spring interposed between the coil spring and said bearing surface.

7. A cylinder head as set forth in claim 1 further including means forming a bearing cap affixed to the cylinder head and forming the remainder of the camshaft journal, said cylinder head having a boss portion for receiving a fastener for affixing the bearing cap to the cylinder head, said boss portion being provided with a relief for passage of the coil spring.

8. A cylinder head as set forth in claim 7 wherein there are a plurality of valves and valve guides for each cylinder of the engine and the relief accommodates the insertion of the coil spring for at least one of the valves.

9. A cylinder head as set forth in claim 8 wherein the camshaft has a number of lobes equal to the valves so that each valve is operated by a respective cam lobe.

10. A cylinder head as set forth in claim 9 wherein the camshaft journal is formed between a pair of the cam lobes.

11. A cylinder head as set forth in claim 10 wherein at least two of the poppet valves reciprocate about axes that are not parallel to each other and which are disposed at different acute angles to a plane containing the axis of the associated cylinder bore.

12. A cylinder head as set forth in claim 11 wherein the cylinder head is provided with a machined surface surrounding the valve guide and adapted to form a reaction surface for the associated coil spring, said surface having a smaller diameter than the diameter of the coil spring and further including a spring bearing member having a diameter at least equal to the diameter of the coil spring interposed between the coil spring and said bearing surface.

13. A cylinder head for an internal combustion engine, a valve guide in said cylinder head for supporting a poppet valve for reciprocation about an axis, a coil compression spring encircling said poppet valve for urging said poppet valve to its closed position, a spring supporting surface formed in said cylinder head around said valve guide and having a diameter smaller than the outer diameter of said coil spring, and a bearing member engaged at one side with said spring supporting area of said cylinder head and at the other side with said coil spring, said spring bearing member having a diameter at least equal to the diameter of said coil spring.

14. A cylinder head as set forth in claim 13 wherein there are a plurality of valve guides and poppet valves for each cylinder of the engine and each valve guide is surrounded by a spring supporting surface and a bearing member as defined.

15. A cylinder head for an internal combustion engine, a valve guide in said cylinder head for supporting a plurality of poppet valves for reciprocation about respective axes, a camshaft journal formed integrally by said cylinder head and juxtaposed to said valve guide for journalling a camshaft having a number of lobes equal to the number of valves for operating a valve from each lobe, and a relief formed in said camshaft journal for passage of a coil spring to be positioned on and removed from a valve slidably supported by said valve guide, said camshaft journal being formed between a pair of the cam lobes, at least two of the poppet valves reciprocating about axes that are not parallel to each other and which are disposed at different acute angles to a plane containing the axis of the associated cylinder bore.

16. A cylinder head as set forth in claim 15 wherein the cylinder head is provided with a machined surface surrounding the valve guide and adapted to form a reaction surface for the associated coil spring, said surface having a smaller diameter than the diameter of the coil spring and further including a spring bearing member having a diameter at least equal to the diameter of the coil spring interposed between the coil spring and said bearing surface.

17. A cylinder head for an internal combustion engine, a valve guide in said cylinder head for supporting a poppet valve for reciprocation about an axis, a camshaft journal formed integrally by said cylinder head and juxtaposed to said valve guide, a relief formed in said camshaft journal for passage of a coil spring to be positioned on and removed from a valve slidably supported by said valve guide, and means forming a bearing cap affixed to said cylinder head and forming the remainder of said camshaft journal, said cylinder head having a boss portion for receiving a fastener for affixing said bearing cap to said cylinder head, said boss portion being provided with a relief for passage of the coil spring.

18. A cylinder head as set forth in claim 18 wherein there are a plurality of valves and valve guides for each cylinder of the engine and the relief accommodates the insertion of the coil spring for at least one of the valves.

19. A cylinder head as set forth in claim 18 wherein the camshaft has a number of lobes equal to the valves so that each valve is operated by a respective cam lobe.

20. A cylinder head as set forth in claim 19 wherein the camshaft journal is formed between a pair of the cam lobes.

21. A cylinder head as set forth in claim 20 wherein at least two of the poppet valves reciprocate about axes that are not parallel to each other and which are disposed at different acute angles to a plane containing the axis of the associated cylinder bore.

22. A cylinder head as set forth in claim 21 wherein the cylinder head is provided with a machined surface surrounding the valve guide and adapted to form a reaction surface for the associated coil spring, said surface having a smaller diameter than the diameter of the coil spring and further including a spring bearing member having a diameter at least equal to the diameter of the coil spring interposed between the coil spring and said bearing surface.

23. A cylinder head for an internal combustion engine. a valve guide in said cylinder head for supporting a poppet valve for reciprocation about an axis, a camshaft journal formed integrally by said cylinder head and juxtaposed to said valve guide and forming a bearing surface for engaging a portion of the circumference of a camshaft bearing surface, and a relief formed in said camshaft journal for passage of a coil spring to be positioned on and removed from a valve slidably supported by said valve guide, said relief extending into and interrupting the circumferential extent of said cylinder head bearing surface.

24. A cylinder head as set forth in claim 23 wherein there are a plurality of valves and valve guides for each cylinder of the engine and the relief accommodates the insertion of the coil spring for at least one of the valves.

25. A cylinder head as set forth in claim 24 wherein the camshaft has a number of lobes equal to the valves so that each valve is operated by a respective cam lobe.

26. A cylinder head as set forth in claim 25 wherein the camshaft journal bearing surface is formed between a pair of the cam lobes.

27. A cylinder head as set forth in claim 1 wherein the camshaft journal is disposed to one side of the tip of a poppet valve received in the cylinder head and wherein the camshaft operates the poppet valve through a rocker arm.

* * * * *

UNITED STATES PATENT AND TRADEMARK OFFICE

CERTIFICATE OF CORRECTION

PATENT NO. : 5,121,718

DATED : June 16, 1992

INVENTOR(S) : Tetsushi Saito

It is certified that error appears in the above-identified patent and that said Letters Patent is hereby corrected as shown below:

Column 8, line 56, Claim 18, "18" (second occurrence) should be --17--.

Signed and Sealed this

Twenty-eighth Day of September, 1993

*Attest:*

*Attesting Officer*

BRUCE LEHMAN

*Commissioner of Patents and Trademarks*